United States Patent [19]

Shyu

[11] Patent Number: 5,007,190

[45] Date of Patent: Apr. 16, 1991

[54] SOLAR HOUSE-NUMBER INDICATING DEVICE

[76] Inventor: Chih-Yes Shyu, 4F, No. 144, Chu-Lin Road, Yung Ho, Taipei, Taiwan

[21] Appl. No.: 522,101

[22] Filed: May 11, 1990

[51] Int. Cl.[5] ..... G09F 13/04

[52] U.S. Cl. ..... 40/564; 40/574; 40/576; 40/611

[58] Field of Search ..... 40/446–452, 40/463–465, 541, 550, 564, 568, 574–577, 486–492, 570, 573, 647; 362/183, 184

[56] References Cited

U.S. PATENT DOCUMENTS

| | | | |
|---|---|---|---|
| 4,587,753 | 5/1986 | Harper | 40/450 |
| 4,679,339 | 7/1987 | Hetzer | 40/490 |
| 4,718,185 | 1/1988 | Conlin et al. | 362/183 |
| 4,724,629 | 2/1988 | Walton | 40/450 |
| 4,843,525 | 6/1989 | Williams | 40/564 |
| 4,848,017 | 7/1989 | Barley et al. | 40/576 |
| 4,854,062 | 8/1989 | Bayo | 40/576 |
| 4,903,172 | 2/1990 | Schöniger et al. | 40/546 |

FOREIGN PATENT DOCUMENTS 3715943 12/1988 Fed. Rep. of Germany ..... 40/544

*Primary Examiner*—Peter A. Aschenbrenner
*Assistant Examiner*—James M. Gardner
*Attorney, Agent, or Firm*—Morton J. Rosenberg; David I. Klein

[57] ABSTRACT

A solar house-number indicating device comprises a box-like body having a front opening and an inner space for receiving a solar-powered battery, a digital L.E.D. device with its control circuit for presetting a series of number corresponding to the house number, a door member pivotally attached to the box-like body for closing its front opening and having means for retaining and displaying a house-number plate and a road-name plate and a sensor unit for automatically turn off the L.E.D. device in bright time and turn on the L.E.D. device in dark time to produce a digital light sign of the house number.

1 Claim, 6 Drawing Sheets

SOLAR HOUSE-NUMBER INDICATING DEVICE

BACKGROUND OF THE INVENTION

This invention relates to a device for visually indicating housing number during day and night times, and more particularly to such a device using a power source of solar energy.

Nowaday, most of the house-number plate is clearly visible only in day time. As many houses have a front yard, in order to show the house number in a clear way, a stand should be raised in front of the house for mounting a house-number plate. To those who are skilled in the art, a device for visually indicating the house number during night time can be achieved merely by providing a light source in back side of a transparent house-number plate mounted in a box. Said house-number indicating device with a light source needs to be electrically connected to an electric power source in the house through a conductive line in which the circuit may be shorted when damaged after a long period of exposure in the open air. This device also needs to be switched on in the night time and switched off in the day time.

SUMMARY OF THE INVENTION

An object of the present invention is to provide a solar house-number indicating device which functions independently and economically.

Another object of the present invention is to provide a solar house-number indicating device which visually indicates the house-number during day time as well as night time.

A further object of the present invention is to provide a solar house-number indicating device which is selective in house-number display for matching any location of a house.

With the above objectives in view, a solar house-number indicating device according to this invention comprises a box-like body having front opening and an inner space for receiving a battery, a digital L.E.D. device with its control circuit and a door member pivotally attached to the box-like body and formed with transparent displaying portions for displaying a house-number plate and a road-name plate releaseably mounted therein under sunshine and displaying light sign of house number by means of the L.E.D. device in night or dark time.

DETAILED DESCRIPTION OF THE PREFERRED EMBODIMENT

Figure 1:
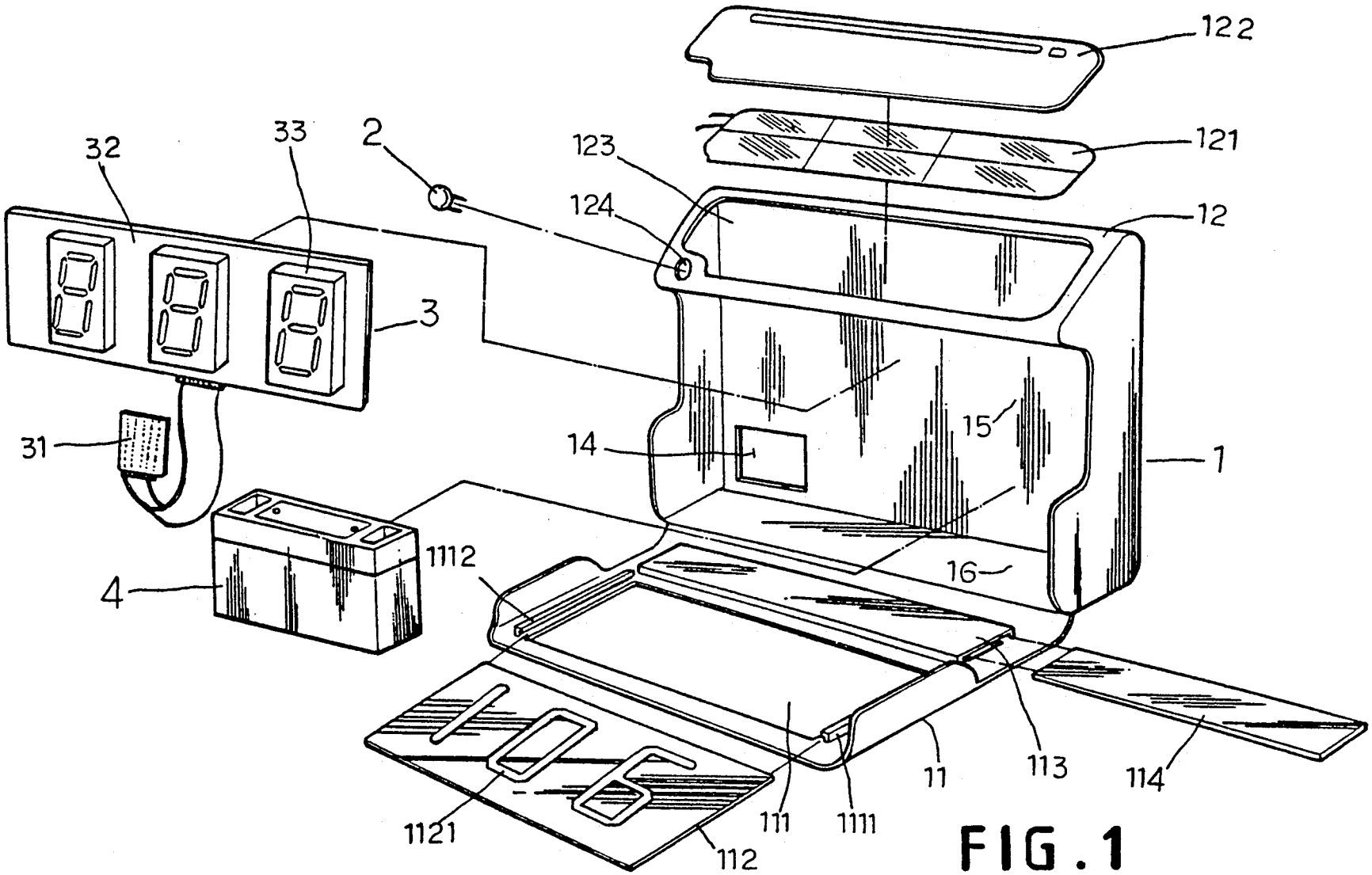
FIG. 1 is an exploded perspective view of the preferred embodiment according to this invention.
Figure 2:
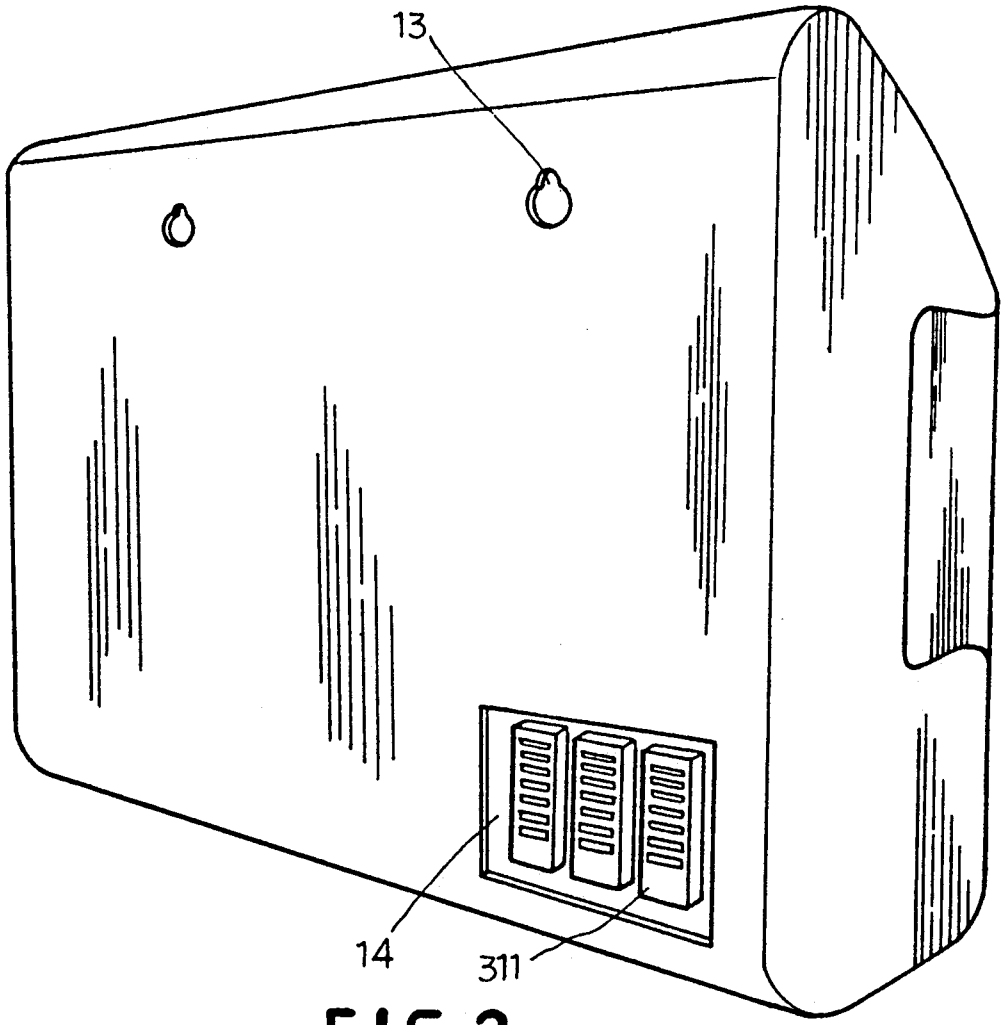
FIG. 2 is a perspective view of the solar house-number indicating device taken from rear side.
Figure 3:
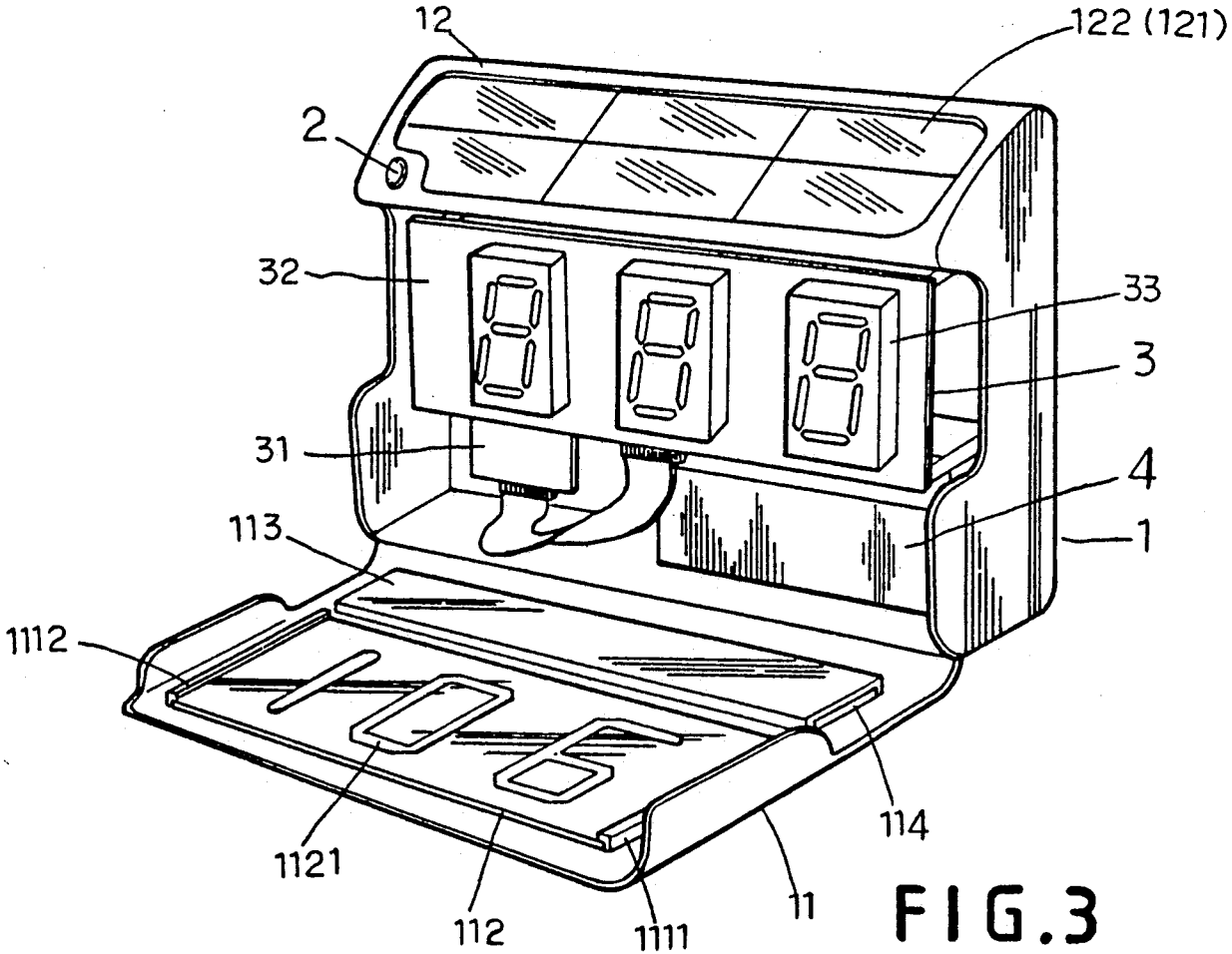
FIG. 3 is a perspective view of the solar house-number indicating device with its front cover left opened.

Referring now to FIGS. 1, 2 & 3, the solar house-number indicating device essentially comprises a box-like main body 1 and a front lid member 11. The main body 1 has two side walls, a rear wall 15, a flat bottom 16 and a top 12 to define a space for receiving a solar battery 4, a digital L.E.D. 3 and its control circuit panel 31, indicating plates 112, 114 and solar energy collecting members 121, 122.

The lid member 11 is connected to the bottom 16 by means of a hinge or the like so that the lid 11 can pivotally move up and down, and is formed with two transparent displaying portions 111 (the transparent displaying portion without designating number is covered by a tunnel member 113). The transparent displaying portion 111 which takes a major portion of the front lid member 11 is provided with a pair of parallel L-shaped rails 1111, 1112 secured at opposite sides of the transparent portion 111 by adhesions or the like for slidably mounting a fully or partially transparent plate 112 which is marked with digits 1121 corresponding to the house number.

A tunnel member 113 covering the other transparent displaying portion from inside of the lid member 11 is provided under the lower terminations of the rails 1111, 1112 to define a passage running transversly for slidably mounting another plate 114, which is transparent or not transparent and marked with the road name where the house is located. The tunnel member 113 serves as a retainer for the road-name plate 114 as well as a support for the house-number plate 112 as it is mounted on the rails 1111, 1112.

The top wall 12 of the main body 1 is formed with two openings 123, 124, of which one opening 123 takes a major portion of the top wall 12 and the other opening 124 locates in a conner thereof. A radiant solar energy collecting surface 121 and a transparent layer 122 for protecting the radiant solar energy collecting surface 121, both of which are corresponding in shape to the opening 123, are sequentially fitted in the opening 123. A sensor 2 is fitted in the other opening 124 of the top wall 12.

The solar battery 4 which is a conventional battery having the character of converting solar energy collected by and input from the radiant solar energy collecting surface 121 into an electrical power is placed on the bottom 16 of the main body 1. The L.E.D. device 3 is mounted in the space of the main body 1 at a position where digital moulds 33 on a L.E.D. board 32 are facing the transparent displaying portion 111 and further corresponding to respective digits 1121 of the house-number plate 112 as the house-number plate 112 is mounted on the rails 1111, 1112 of the front lid member 11 which is in its closed state.

Figure 4:
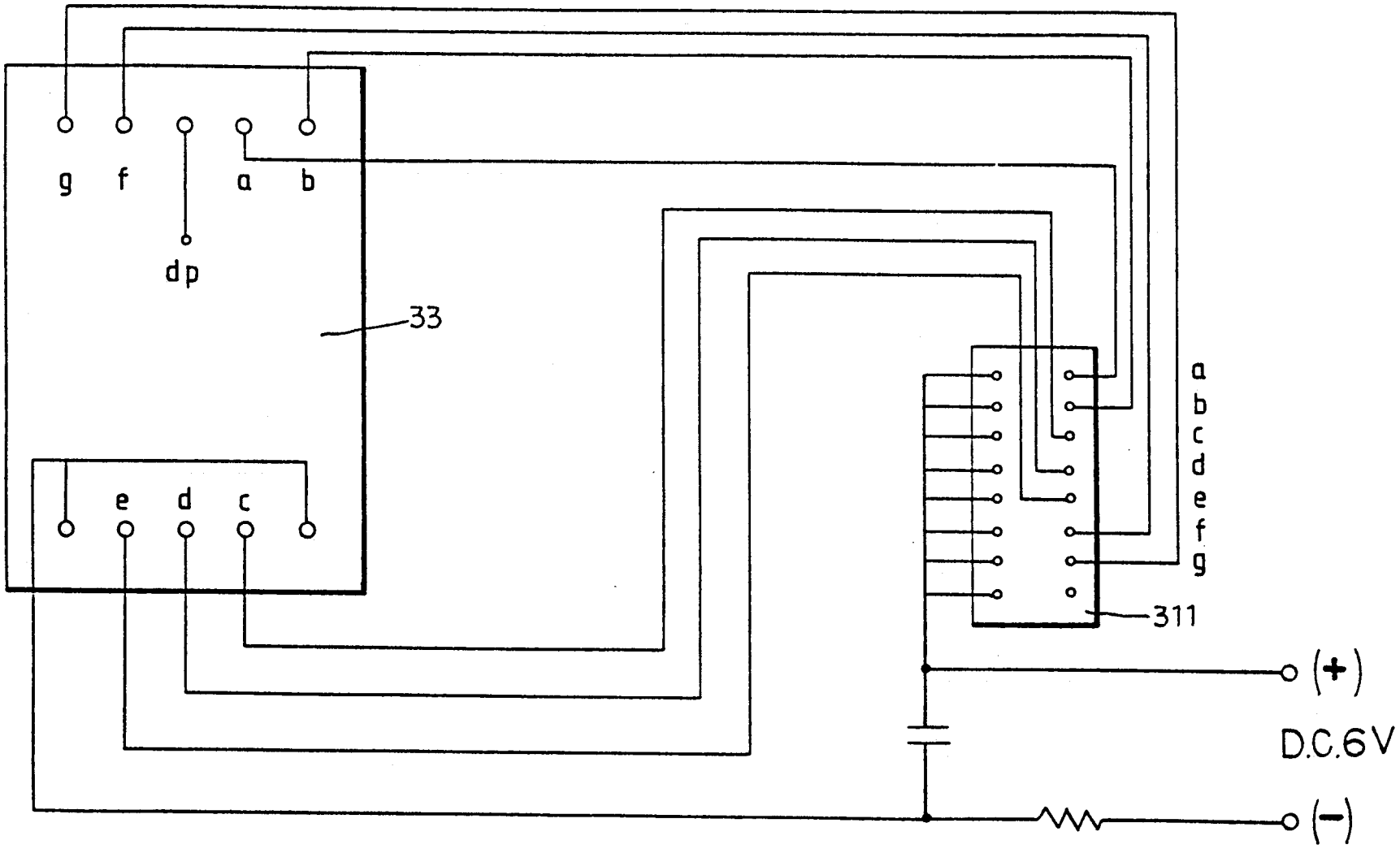
FIG. 4 is an exemplary control circuit diagram used for selecting a desired digit to be displayed in a conventional L.E.D.
Figure 5:
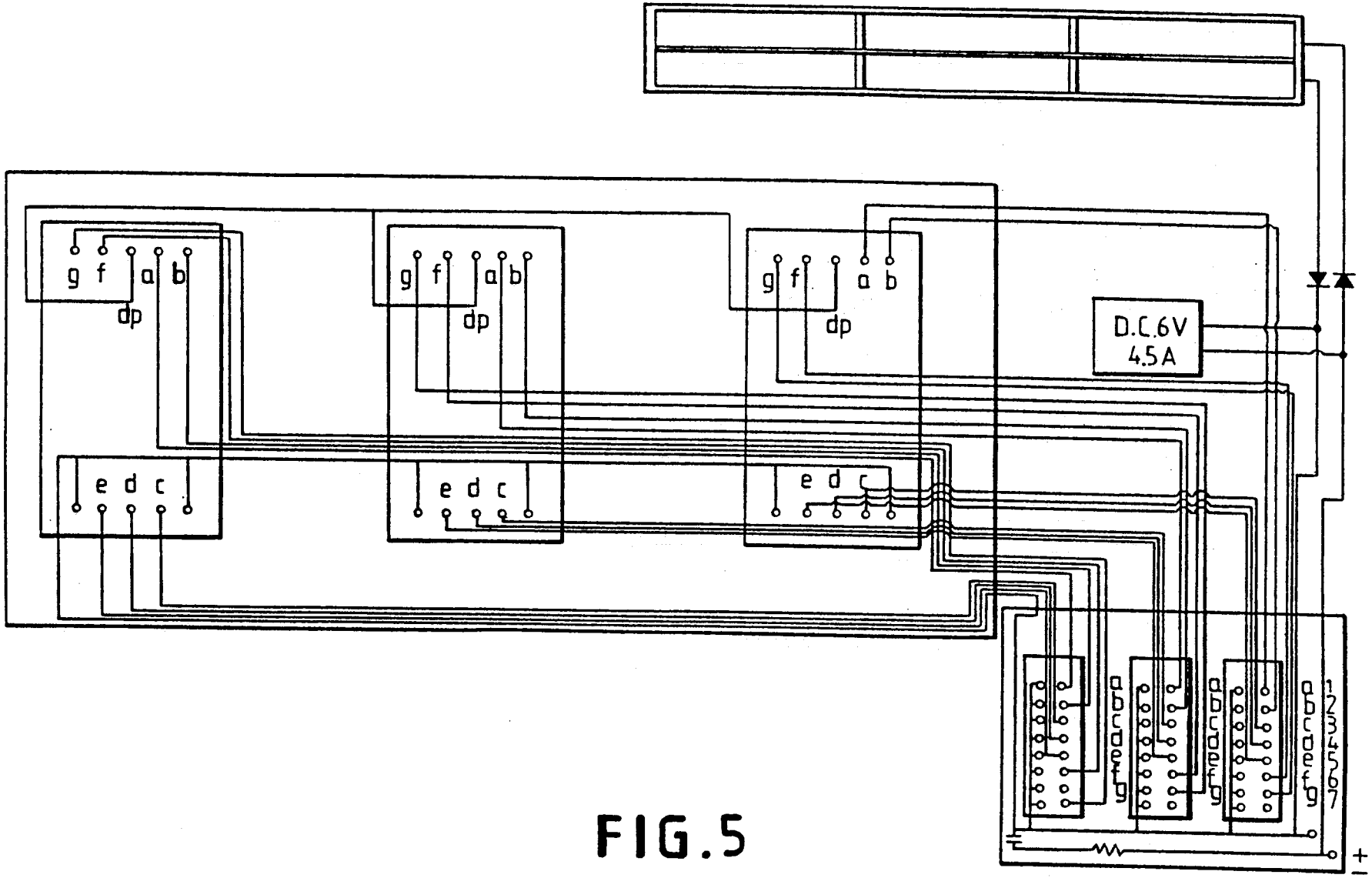
FIG. 5 is an exemplary control circuit diagram for selecting a series of digits matching a house number which is to be displayed in a conventional digital L.E.D.
Figure 6B:
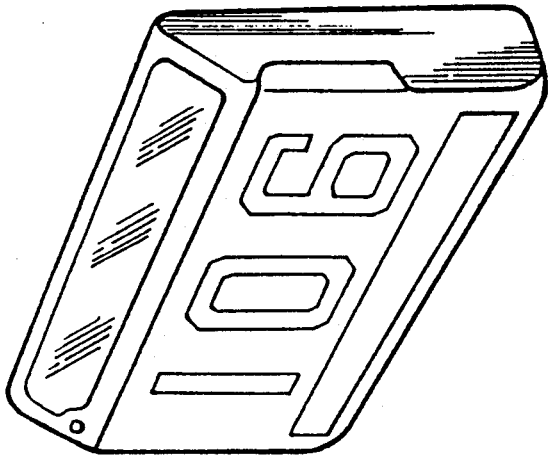
FIG. 6 is a diagramatically perspective view illustrating both states of the present invention as in night time and day time for comparison.
Figure 6A:
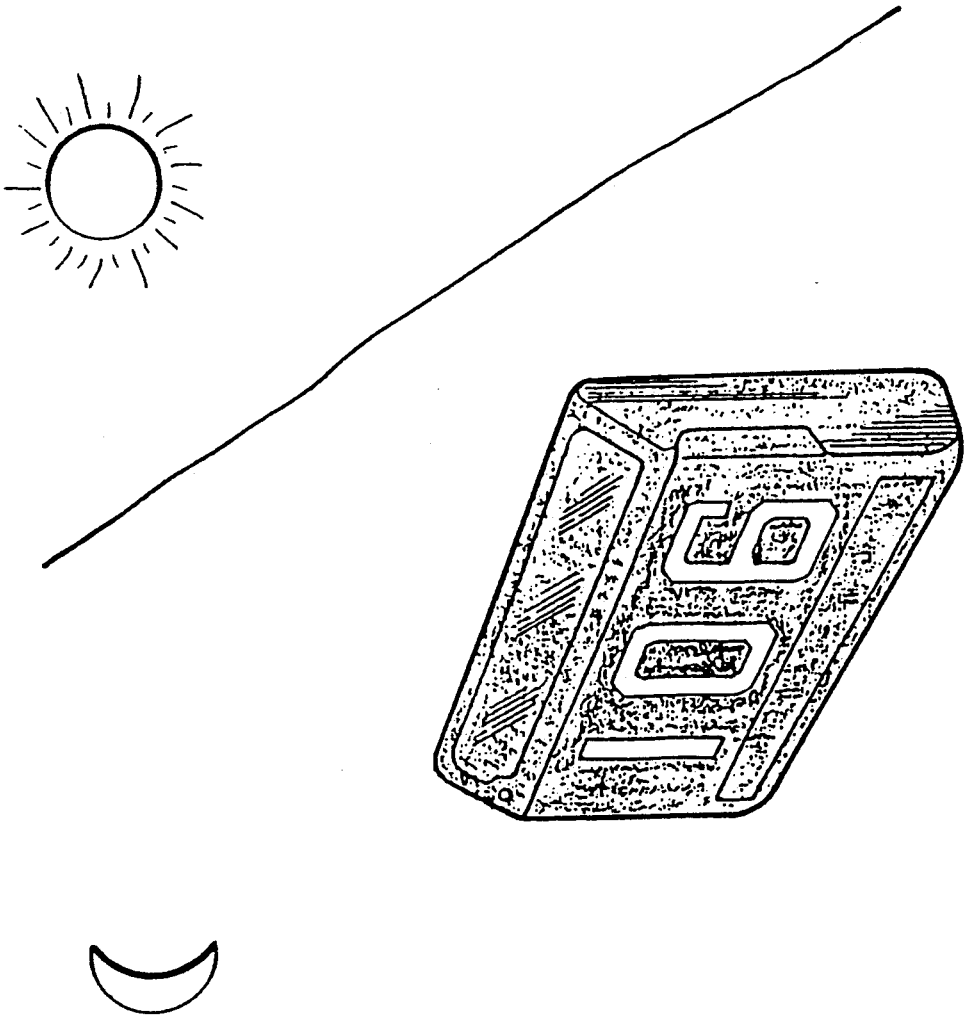

The rear wall 15 of the main body 1 is formed with an opening 14 for fitting the control circuit panel 31 of the L.E.D. device 3 of which the switches 311 (as shown in FIG. 2) are exposed outwardly rearwardly to an operator and another spaced openings 13 for hooking the device on a stand at a properly high position. A digit or a series of digits according to the house number can be preset by operating the switches 311. Series of numbers can be selected through the control circuit shown in FIG. 4 or 5.

The sensor 2 serves as an auto switch according to the sunlight absorbed. Said sensor 2 is a resistance which self-adjust in accordance with the sunlight absorbed. In sunny day time, resistance of the sensor 2 becomes high thus turning off the digital L.E.D. device 3. In night time or cloudy day while no or little sunlight is absorbed, resistance of the sensor 2 becomes low thus turning on the digital L.E.D. device 3. By so doing, the house-number plate 112 and the road-name plate 114 visually indicate the house-number and the road name of the house in the day time and the digital sign produced by the L.E.D. device 3 clearly indicate the house number in night time or other dark situation.

While the invention has been described with what is presently considered to be the most practical and preferred embodiment, it is to be understood that the invention is not to be limited to the disclosed embodiment, but on the contrary, is intended to cover various modifications and equivalent arragements included with the spirit and scope of the appended claim, which scope is to be accorded the broadest modifications amd equivalent structure.

What is claimed is:

1. A house-number indicating device comprising:

a house means provided with a front opening and an inner space defined by a pair of opposed, side wall, a rear wall, a flat bottom wall and a top wall, said top wall being formed with a top opening taking a major portion thereof and a bore locating in a corner, said rear wall being formed with at least a rear opening;

a door means attached to said housing means for closing said front opening of the housing means and being movable to open said opening;

a first and a second transparent means integrally formed in the door means;

rail means located on the inside surface of the door means disposed on opposite sides of the first transparent means;

a tunnel member located on the inside surface of the door means covering the second transparent means from inside of the door means and defining a passageway transverse to the rail means;

a first transparent plate marked with a series of desired numbers and releasably and slidably mounted on the rail means, said series of numbers facing the first transparent plate;

a second plate marked with a desired road name and releasably and slidably mounted in the tunnel member along the passageway defined thereby;

a solar battery characterized in converting solar energy into electric power and placed on the flat bottom in the inner space of the housing means;

a radiant solar energy collecting surface and a transparent layer for protecting the radiant solar energy collecting surface, which are corresponding in shape to the top opening, sequentially and fixedly fitted in the opening, said radiant solar energy collecting surface being connected to the solar battery;

a L.E.D. digital device having means for displaying digits which are selective to be corresponding to the series of numbers marked on the first transparent plate;

a control circuit means having a control circuit electrically connected to the L.E.D. digital device for number selection and ON-OFF controls and a series of switches for operating the number selection control and fitted in the opening of the rear wall of the housing means with the switches thereof exposing externally; and a sensor unit located in said bore characterized in self-adjusting its resistance compliant with the sunlight absorbed thereby for operating ON-OFF control of the control circuit of the control circuit means.

* * * * *